US007682204B2

(12) United States Patent
Tokairin

(10) Patent No.: US 7,682,204 B2
(45) Date of Patent: Mar. 23, 2010

(54) ELECTRICAL APPARATUS AND METHOD OF MANUFACTURING THE SAME

(75) Inventor: Takayuki Tokairin, Saitama (JP)

(73) Assignee: Tamura Corporation, Tokyo (JP)

( * ) Notice: Subject to any disclaimer, the term of this patent is extended or adjusted under 35 U.S.C. 154(b) by 0 days.

(21) Appl. No.: 12/178,042

(22) Filed: Jul. 23, 2008

(65) Prior Publication Data

US 2009/0029603 A1 Jan. 29, 2009

(30) Foreign Application Priority Data

Jul. 27, 2007 (JP) ..... P2007-196567

(51) Int. Cl.
*H01R 13/405* (2006.01)
*H01K 3/22* (2006.01)

(52) U.S. Cl. ..... 439/736; 29/858

(58) Field of Classification Search ..... 439/736, 439/858

See application file for complete search history.

(56) References Cited

U.S. PATENT DOCUMENTS 1,984,036 A * 12/1934 Schwartzmann ..... 439/736
3,093,434 A * 6/1963 Francis ..... 439/695
4,790,776 A * 12/1988 Iijima ..... 439/736
4,911,652 A * 3/1990 Savoca et al. ..... 439/282
5,897,398 A * 4/1999 Maeda ..... 439/693
6,638,113 B2 * 10/2003 Kajiwara et al. ..... 439/651

FOREIGN PATENT DOCUMENTS

| | | |
|---|---|---|
| JP | 53-149891 | 11/1978 |
| JP | 09-306578 A | 11/1997 |
| JP | 3075008 U | 11/2000 |
| JP | 2003-234138 A | 8/2003 |
| JP | 2004-265748 A | 9/2004 |
| WO | WO 2007/116791 A1 | 10/2007 |

OTHER PUBLICATIONS

Japanese Office Action dated Nov. 4, 2009 and English translation thereof issued in a counterpart Japanese Application No. 2007-196567.

* cited by examiner

*Primary Examiner*—Briggitte R Hammond
(74) *Attorney, Agent, or Firm*—Frishauf, Holtz, Goodman & Chick, P.C.

(57) ABSTRACT

An electrical apparatus connected to a commercial power source includes: a case made of resin and housing a functional member; blades insert-molded in the case and each having an exposed part connected to the commercial power source and a resin facing part which is enclosed by the resin and all along an outer periphery of which a groove is formed; and elastic members each disposed between the resin and the resin facing part and having a fitting convex coming into close contact with the groove at the time of the insert molding.

17 Claims, 6 Drawing Sheets

ELECTRICAL APPARATUS AND METHOD OF MANUFACTURING THE SAME

BACKGROUND OF THE INVENTION

1. Field of the Invention

The present invention relates to an electrical apparatus connected to a commercial power source and a method of manufacturing the electrical apparatus.

2. Description of the Related Art

An electrical apparatus of this type, for example, an AC adapter has a metal plug, and the plug is connected to a commercial power source. The plug is made up of a set of blades and is insert-molded in a waterproof resin case. Such a plug is disclosed in a pamphlet of International Publication WO 07/116791.

This adapter converts alternating-current power to direct-current power, and during this conversion, heat is generated in the adapter. This heat causes gaps between the case and the blades due to a difference in shrinkage percentage between the case and the blades, which will be a cause of lowering airtightness of the case.

Under such circumstances, Japanese Patent Publication No. 3815733 (Japanese Patent Application Laid-open No. 2004-265748) discloses an example of a technique for enhancing airtightness of the case by filling a sealing resin material in the case. However, this resin material is generally expensive, and in addition, the time for drying the resin material is required in addition to the time for solidifying the resin forming the case, resulting in a longer manufacturing period.

Further, Japanese Patent Application Laid-open No. Hei 9-306578 and Japanese Utility Model Registration Publication No. 3075008 disclose techniques for coating outer peripheries of the blades by injection molding. These techniques can fill the gap between the case and the blades.

However, the techniques disclosed in Japanese Patent Application Laid-open No. Hei 9-306578 and Japanese Utility Model Registration Publication No. 3075008 apply an insulation layer for coating in order to prevent tracking and are not intended to ensure airtightness of the case. Further, in these techniques, a groove and a through hole are formed in an exposed part of each of the blades connected to a receptacle in order to facilitate the application of the insulation layers, which is not preferable in view of regulations regarding safety of electrical appliances.

Further, in these techniques, the groove is formed in part of each of the blades, and therefore, part of the blade where no groove is formed is not fully in close contact with the insulation layer, which poses a problem that airtightness of the case cannot be ensured. Another problem to be noted in these techniques is that the through hole is formed in the blade. This hole has a function of guiding the insulation layer to a rear side of the blade, but the injection pressure may possibly separate the insulation layer and the blade all the more.

As described above, the aforesaid techniques of coating the outer periphery of the blade still have a problem to be solved with respect to ensuring waterproofness of the case.

SUMMARY OF THE INVENTION

It is an object of the present invention to provide an electrical apparatus ensuring waterproofness of its case by using the shrinkage of an elastic member, and to provide a method of manufacturing the electrical apparatus.

An electrical apparatus of the present invention is connected to a commercial power source. The electrical apparatus includes: a case made of resin and housing a functional member; blades insert-molded in the case and each having an exposed part connected to the commercial power source and a resin facing part which is enclosed by the resin and all along an outer periphery of which a groove is formed; and elastic members each disposed between the resin and the resin facing part and having a fitting convex coming into close contact with the groove at the time of the insert molding.

According to the electrical apparatus, the blades are insert-molded in the case, and each of the blades has the resin facing part enclosed by the resin. The groove is formed all along the outer periphery of each of the resin facing parts. At the time of the insert molding, the fitting convexes of the elastic members come into close contact with the grooves.

Specifically, the elastic members fill the grooves while being shrunk by injection pressure of the insert molding and come into close contact with the blades all along their peripheries, and the blades and the resin come into close contact with each other via the elastic members. As a result, airtightness between the blades and the resin is improved. In more detail, no gap is formed between the blades and the resin since the elastic members shrunk at the time of the molding expand after the molding. As a result, waterproofness of the case is ensured, which contributes to improvement in reliability of the electrical apparatus.

Preferably, each of the elastic members has an engaging concave with which the resin comes into close contact at the time of the insert molding. This can prevent the blades from coming off since the elastic members are brought into close contact with the resin as well by the injection pressure of the insert molding and the resin is engaged with the engaging concaves.

Preferably, each of the grooves linearly extends in a direction substantially perpendicular to a bus bar of the blade. The linearly extending groove is easily formed, and when the groove extending in the direction substantially perpendicular to the bus bar of the blade is formed, a formation range of the groove is small and thus the total length of the blade does not become long.

Preferably, each of the grooves is inwardly recessed in the blade in a diameter-reduced manner. The groove with this shape can be most easily formed. Further preferably, the resin facing parts are formed in a plate shape without any through hole. The resin facing parts are enclosed by the resin via the elastic members, and as contrast to a conventional plate-shaped blade having a through hole, the resin facing parts formed in the plate shape without any through hole can prevent the elastic members from becoming bulged away due to the resin flowing to the rear sides of the blades via the through holes, and the grooves and the fitting convexes come into close contact with each other in a favorable manner.

Preferably, the electrical apparatus is an AC adapter generating direct-current power from the commercial power source. This is because ensuring airtightness of the case owing to the utilization of the shrinkage of the elastic member exhibits an especially high effect in the adapter which generates heat when converting alternating-current power into the direct-current power.

Another aspect of the present invention is a method of manufacturing an electrical apparatus. Specifically, this method is a method of manufacturing an electrical apparatus which has a case made of resin and housing a functional member and which is connected to a commercial power source, the method including the steps of: forming a groove all along an outer periphery of a resin facing part facing the resin, in each blade connected to the commercial power source; loosely disposing cylindrical elastic members around the resin facing parts to cover the resin facing parts by the elastic members; inserting the blades to a metal mold to dispose the elastic members in the mold; pressing the elastic members by injecting the resin into the metal mold to form engaging concaves with which the resin comes into close contact and to form fitting convexes which come into close contact with the grooves; and solidifying the resin.

According to this manufacturing method, the grooves are formed all along the outer peripheries of the blades, and the grooves are disposed in the metal mold while being covered by the elastic members. Then, the elastic members are pressed by the injection pressure of the insert molding, so that the resin comes into close contact with the engaging concaves and the fitting convexes fill the grooves to come into close contact with the blades all along the peripheries of the blades. This can surely prevent the entrance of water flowing toward the inside of the case from gaps between the blades and the resin.

Moreover, since the resin is engaged with the engaging concaves, the blades are prevented from coming off. Further, the step of filling a sealing filler in the case is not necessary, which achieves reduction in manufacturing cost of the electrical apparatus.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

Embodiments of the present invention will be hereinafter described with reference to the drawings.

Figure 1:
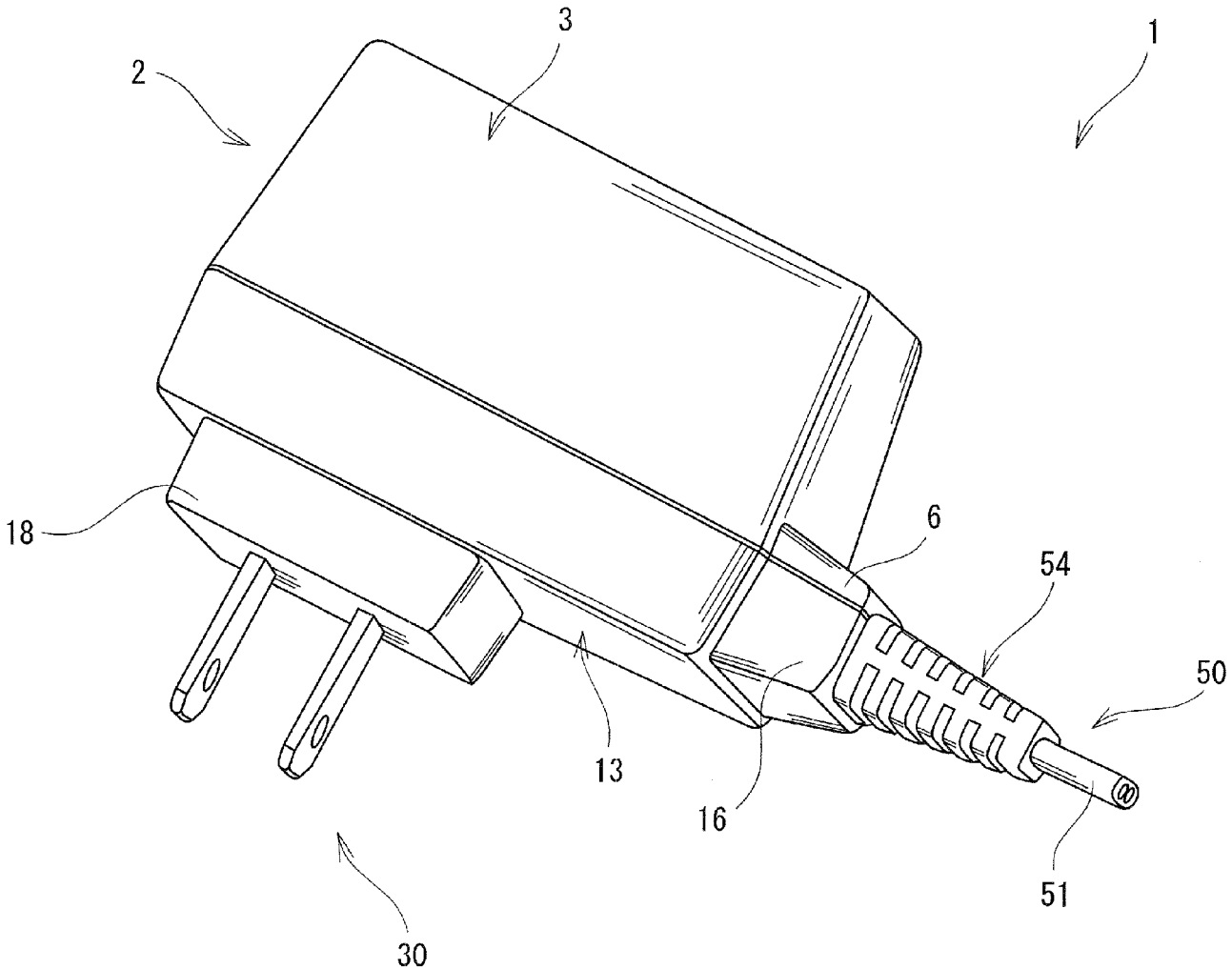
FIG. 1 is a perspective view of an AC adapter in this embodiment.

FIG. 1 shows an AC adapter (electrical apparatus) 1 of this embodiment. The adapter 1 generates direct-current power from alternating-current power which is a commercial power source, and this direct-current power is used for driving an electrical device, charging a secondary battery, and so on.

The adapter 1 includes a waterproof case (case) 2 made of synthetic resin and having heat resistance and an insulative property, and the case 2 is made up of an upper case main body 3 and a lower case main body 13 as shown in FIG. 1. More specifically, the case main body 3 is formed in a cup shape whose lower side is open, and an opening edge 4 thereof is formed in a substantially quadrangular shape. Further, a projection 6 is formed on the right of the opening edge 4 when seen in FIGS. 1 and 2. A lower side of the projection 6 is also open.

The case main body 13 is formed in a cup shape whose upper side is open. Its opening edge 14 is also formed in a substantially quadrangular shape, and a projection 16 whose upper side is open is formed on the right of the opening edge 14 when seen in FIGS. 1 and 2. Further, a bulge 18 bulging downward is provided at an appropriate position on a bottom of the case main body 13. A plug 30 is formed in the bulge 18, enabling the direct insertion of the case 2 into a receptacle (direct plug-in type).

The case main body 3 is overlaid on the case main body 13, and the opening edges 4, 14 and the openings of the projections 6, 16 are ultrasonic-welded. Consequently, the case main body 3 is airtightly joined with the case main body 13, whereby the case 2 having a space inside is formed.

Figure 3:
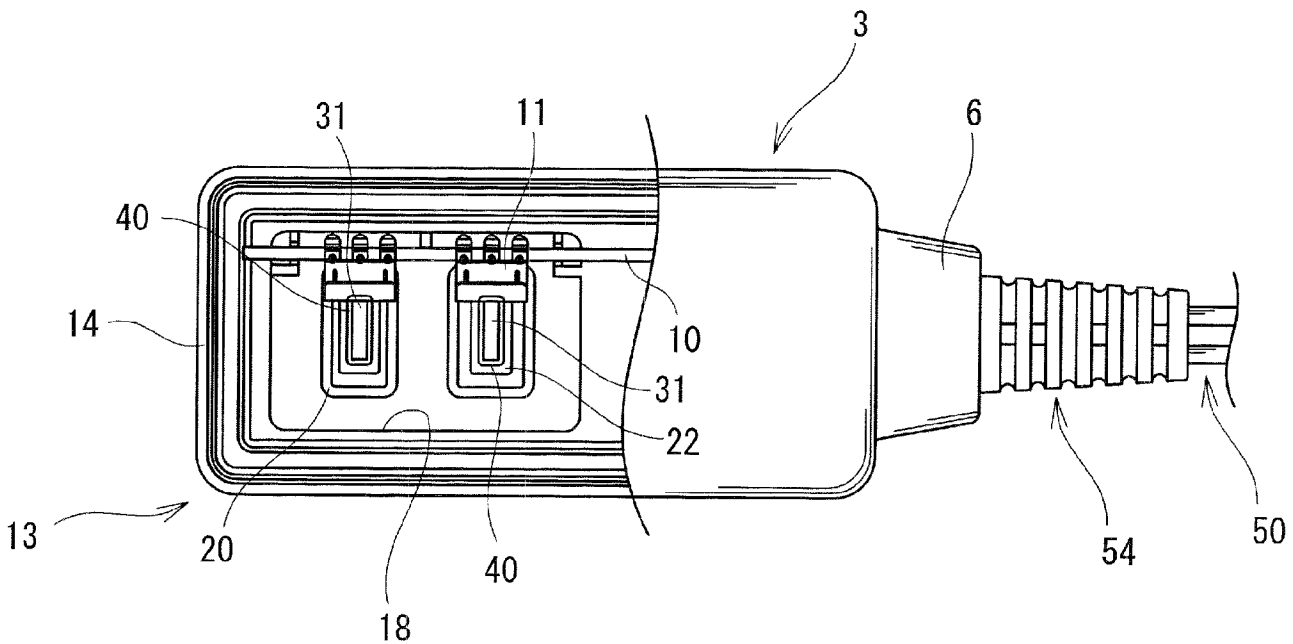
FIG. 3 is a plane view of the adapter in FIG. 1.
Figure 4:
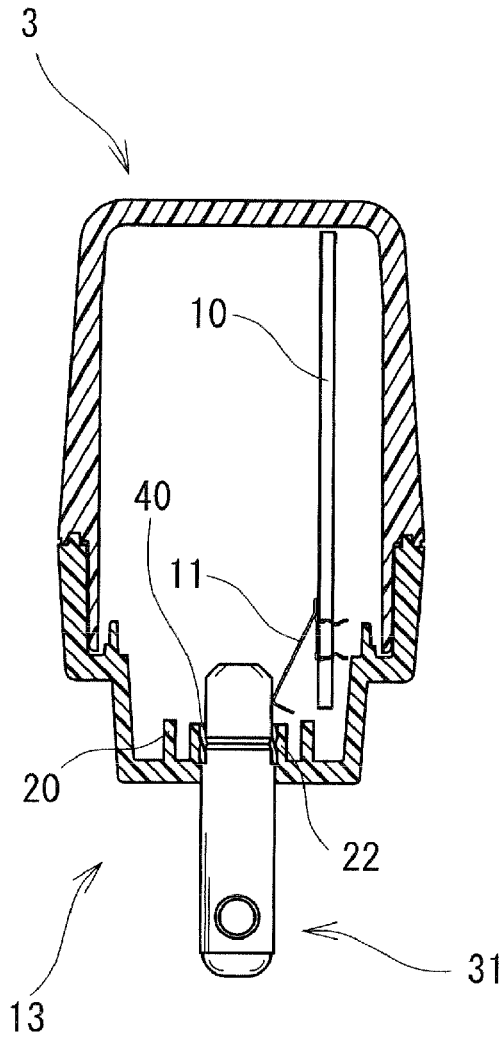
FIG. 4 is a cross-sectional view seen in the direction of IV-IV arrows in FIG. 2.

As shown in FIGS. 3 and 4, a power supply board 10 is disposed in the case 2. As a functional member, an electronic component is mounted on the board 10, and the electronic component converts the alternating-current power into the direct-current power with a predetermined voltage. Further, AC input pins, not shown, of the board 10 are electrically connected to the plug 30 via connections parts 11.

Figure 2:
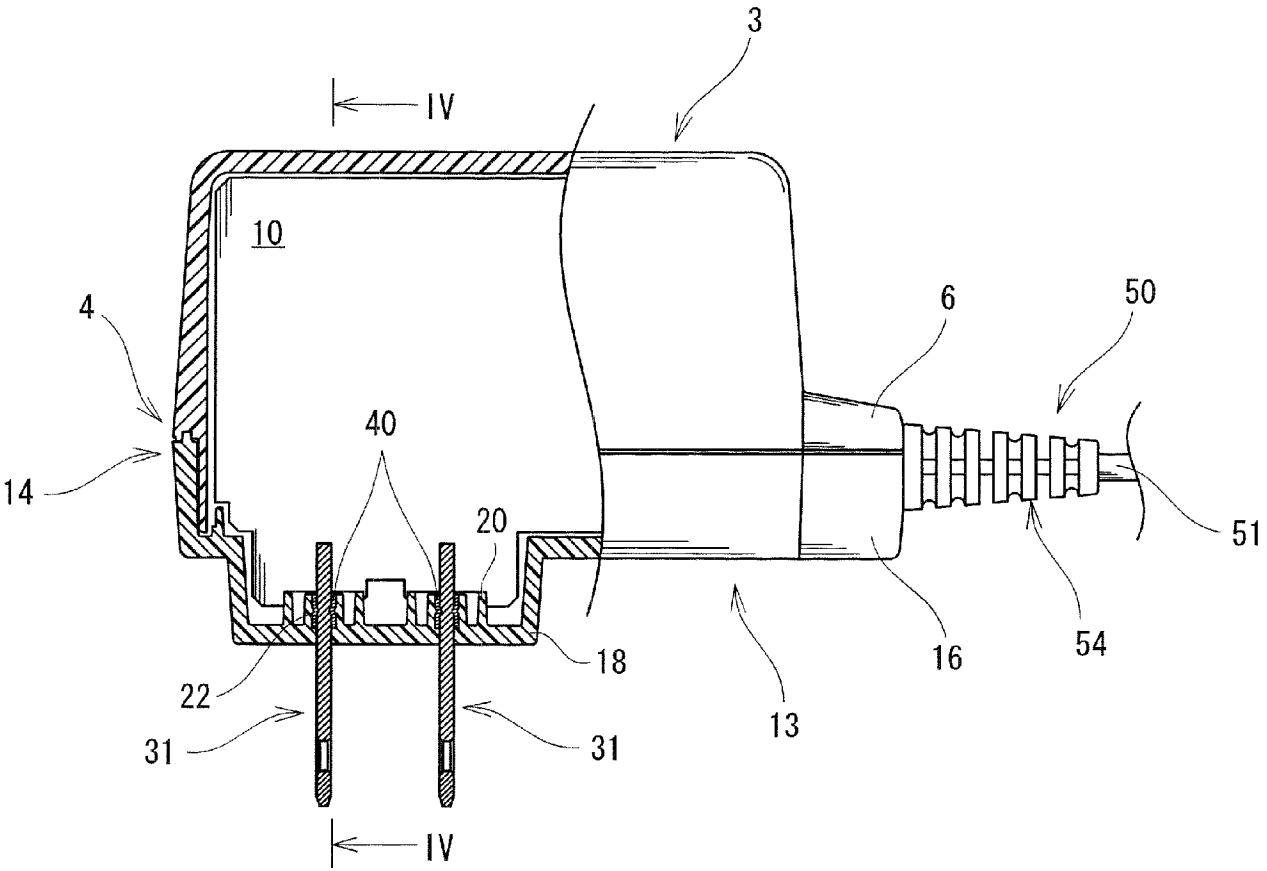
FIG. 2 is a partial side sectional view of the adapter in FIG. 1.

The plug 30 of this embodiment has a pair of metal blades 31, 31 and is formed in the lower case main body 13 by insert molding. More concretely, the plate-shaped blades 31 are disposed in parallel in the bulge 18, with wider surfaces thereof facing each other. Supports 22 are formed on a bottom of the bulge 18 to support the blades 31 respectively. Further, guard walls 20, 20 are formed around the supports 22. These guard walls 20 and supports 22 each have a cross section in a substantially quadrangular shape similar to a cross-sectional shape of the blades 31 (FIG. 3), and extend toward an inner side of the bulge 18 (FIGS. 2 and 4).

Figure 5:
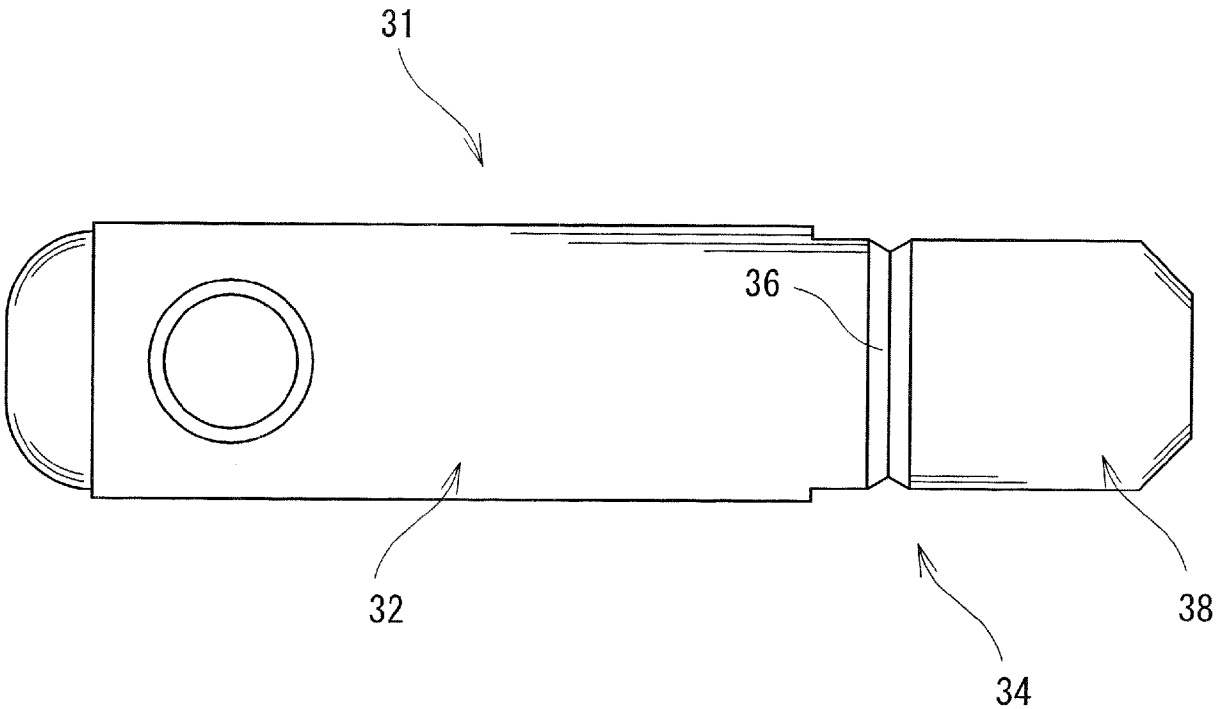
FIG. 5 is an enlarged view of a blade in FIG. 1.

As shown in FIG. 5, each of the blades 31 of this embodiment is made up of an exposed part 32, a resin facing part 34, and a rear end part 38. The exposed part 32 is disposed outside the bulge 18 and is insertable into a receptacle. The resin facing part 34 is adjacent to the exposed part 32 and surrounded by the support part 22 inside the bulge 18. The rear end part 38 is adjacent to the resin facing part 34 and is connected to the connection part 11 further inside the bulge 18.

The resin facing part 34 has a blade groove (groove) 36 all along its outer peripheral surface. In more detail, as shown in FIG. 5, the groove 36 of this embodiment is formed to extend linearly in a direction substantially perpendicular to a bus bar of the blade 31. Further, a cross section of the groove 36 has a shape linearly recessed toward the inner side of the blade 31 in a diameter-reduced manner. That is, the resin facing part 34 except the groove 36 is formed in a plate shape not having a through hole or the like.

Packings (elastic members) 40 made of silicone rubber are provided between the resin facing parts 34 and the supports 22, more concretely, between the aforesaid grooves 36 and the supports 22. In more detail, each of the packings 40 has a cylindrical shape whose length is substantially equal to the length of the support 22, and it is loosely disposed around an outer side of the blade 31 before the insertion molding, and comes into close contact with the groove 36 at the time of the insert molding.

Figure 6:
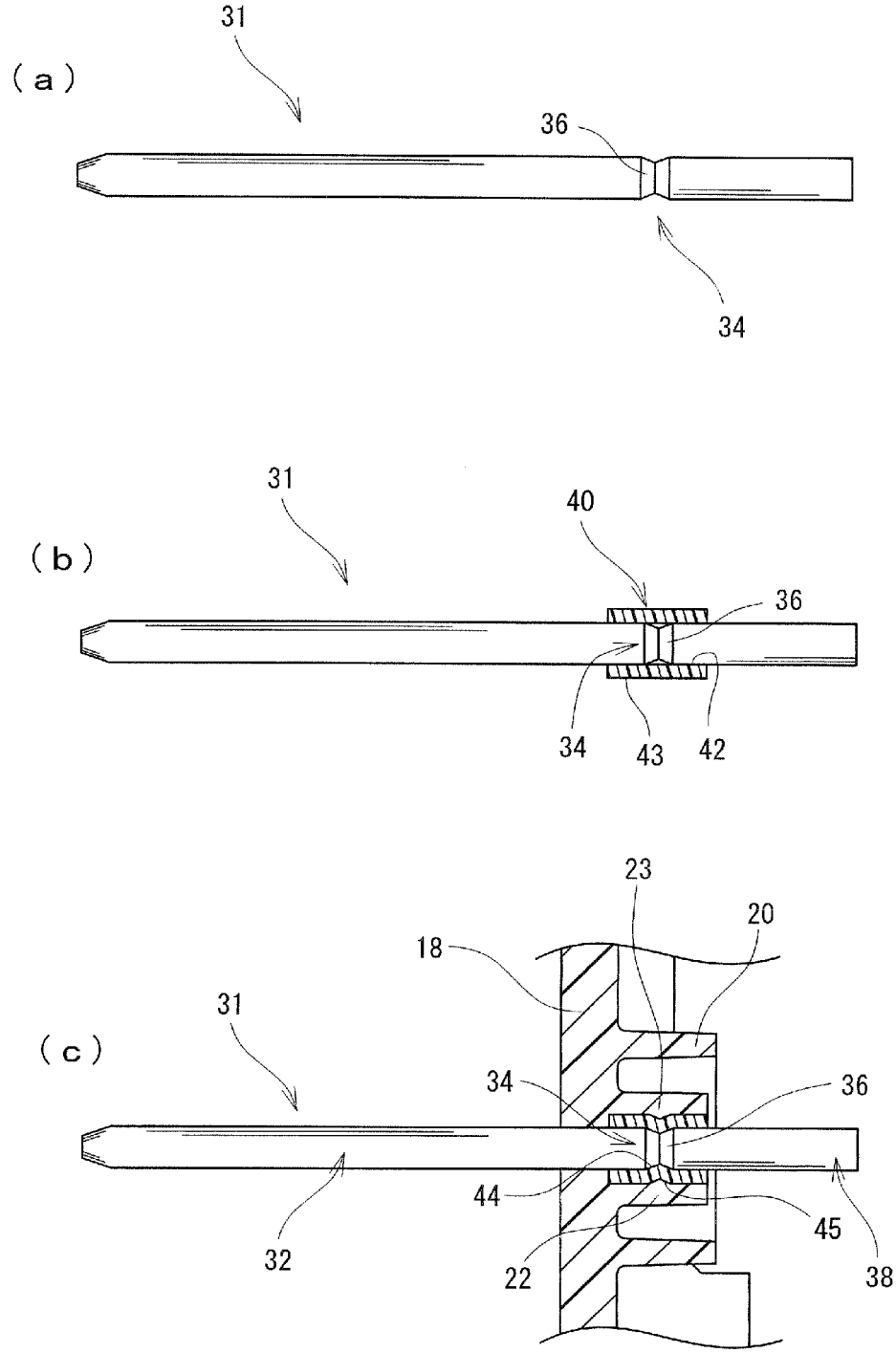
FIG. 6(*a*) to FIG. 6(*c*) are explanatory views showing processes of insertion molding of the blade in FIG. 4.

In more detail, as shown in FIG. 6(*a*), the outline of the blade 31 is first formed together with the groove 36 by presswork. Next, as shown in FIG. 6(*b*), the packing 40 is loosely disposed around the blade 31, with an inner peripheral surface 42 of the packing 40 and the outer peripheral surface of the blade 31 facing each other, so that the inner peripheral surface 42 covers the resin facing part 34 having the groove 36. That is, at this stage, space is present between the inner peripheral surface 42 and the groove 36.

Next, the blades 31, 31 around which the packings 40 are loosely disposed are inserted in a metal mold for insert molding in which the lower case main body 13 is to be formed. Then, when molten resin is injected into the metal mold, the bulge 18 and the guard walls 20 are formed and the supports 22 are formed as shown in FIG. 6(*c*), and the resin of each of the supports 22 presses the packing 40 with a predetermined injection pressure. That is, the outer peripheral surface 43 of the packing 40 is pressed toward the blade 31, so that the aforesaid space between the inner peripheral surface 42 and the groove 36 is eliminated and an engaging projection 23 projecting toward the blade 31 is formed in the resin.

In other words, an engaging concave 45 is formed in the outer peripheral surface 43 of the packing 40 to be recessed toward the baled 31. At the same time, since the inner peripheral surface 42 of the packing 40 is also pressed toward the blade 31, a fitting convex 44 is formed in the inner peripheral surface 42 to project toward the blade 31.

In this manner, these fitting convex 44, engaging concave 45, and engaging projection 23 are formed in a shape following the shape of the groove 36. Then, the fitting convex 44 comes into close contact with the groove 36 all along the periphery of the blade 31, and the engaging projection 23 also comes into close contact with the engaging concave 45 all along the periphery of the blade 31. When the resin is thereafter solidified, the packing 40 compressed by the injection pressure is present between the support 22 and the blade 31.

Returning again to FIG. 1, a direct-current output pin, not shown, of the board 10 is electrically connected to a cable 50. The cable 50 has a cable main body 51, and a bush 54 is integrally formed on a jacket of the main body 51 by injection molding. The jacket of the main body 51 and the bush 54 are made of flexible synthetic resin.

Then, after the power supply board 10 is placed in the solidified case main body 13, the board 10 is connected to the plug 30 and is also connected to the cable 50, the bush 54 is attached to the projection 16 of the case main body 13, and the cable 50 is led out from the projection 16. Subsequently, when the aforesaid opening edges 4, 14 and projections 6, 16 are airtightly ultrasonic-welded to each other, the case 2 is formed.

In the adapter 1 having this case 2, its plug 30 is directly connected to a receptacle of the commercial power source, and a connector, not shown, of the cable 50 is connected to an electrical device or the like. Consequently, the adapter 1 converts the alternating-current power into the direct-current power to drive the electrical device or charge a secondary battery.

As described above, the present invention was made, focusing on the elimination of gaps between the blades and the case by utilizing the shrinkage of rubber.

According to this embodiment, the blades 31 are insert-molded in the lower case main body 13 and have the resin facing parts 34 enclosed by the resin. Each of the resin facing parts 34 has the blade groove 36 formed all along its outer periphery. The fitting convex 44 of the packing 40 comes into close contact with the groove 36 at the time of the insert molding. That is, the packing 40 fills the groove 36 while being shrunk by receiving the injection pressure of the insert molding, and comes into close contact with the groove 36 all along the periphery of the blade 31. This improves airtightness between the blades 31 and the case main body 13.

In more detail, in a conventional art, when heat is generated at the time of the conversion from the alternating-current power into the direct-current power, gaps are formed between the blades and the lower case main body due to a difference in shrinkage percentage between the blades and the lower case main body. Further, if an external impact works on the blades, gaps are formed between the blades and the lower case main body, which allows the entrance of water into the waterproof case.

In this embodiment, on the other hand, since the packings 40 shrunk at the time of the insert molding work to expand after the molding, no gap is formed between the blades 31 and the lower case main body 13. As a result, waterproofness of the case 2 is ensured, which contributes to improvement in reliability of the AC adapter 1. Moreover, since a sealing filler need not be applied on the inside of the guard walls 20, manufacturing cost of the AC adapter 1 can be reduced than ever.

Further, when the packing 40 receives the injection pressure of the insertion molding, its inner peripheral surface 42 fills the groove 36 to come into close contact with the blade 31 all along the periphery of the blade 31, and its outer peripheral surface 43 also comes into close contact with the case main body 13. Consequently, airtightness between the blades 31 and the case main body 13 is further improved. Moreover, since the engaging projection 23 of the case main body 13 is similarly engaged with the engaging concave 45 of the outer peripheral surface 43, the blade 31 can be prevented from coming off.

Further, the blade groove 36 linearly formed as described above can be manufactured more easily than that formed, for example, in a curved shape or the like, and forming the groove 36 to extend in the direction substantially perpendicular to the bus bar of the blade 31 can reduce the formation range of the groove 36, so that the whole length of the blade 31 does not become long. Moreover, the groove 36 having the shape of this embodiment can be most easily formed by presswork.

Further, the resin facing part 34, which is enclosed by the support 22 via the packing 40, is formed in the plate shape without any through hole. Therefore, as contrast to a conventional plate-shaped blade having a through hole, the blade 31 can prevent the packing 40 from being bulged away due to the molten resin flowing to the rear side of the blade via the through hole, and as a result, the groove 36 and the fitting convex 44 come into close contact with each other in a favorable state.

The present invention is not limited to the above-described embodiment but can be embodied with various modifications and additions. For example, though the above-described embodiment shows the example where the electrical apparatus is embodied as the AC adapter, the present invention is naturally applicable to any of various electrical apparatuses having a functional member such as an electric component, an electronic component, or the like built in a waterproof case having blades.

Further, the shape and the number of the aforesaid blades are only shown as examples, and the blades may have a generally-known shape such as a round bar shape or an L-shape, and the number thereof may be three or more. Any of these cases produces the effect of ensuring waterproofness of the case similarly to the above embodiment.

What is claimed is:

1. An electrical apparatus adapted to be connected to a commercial power source, the apparatus comprising:

a case made of resin and housing a functional member;

blades insert-molded in said case, wherein each of the blades comprises (i) an exposed part to be connected to the commercial power source, and (ii) and a resin facing part which is enclosed by the resin, wherein a groove is formed in the resin facing part, and the groove extends all the way around an outer periphery of the blade; and elastic members, each of which is disposed between the resin and the resin facing part of one of the blades and has a fitting convex that comes into close contact with the groove at a time of the insert molding.

2. The electrical apparatus according to claim 1, wherein each of said elastic members has an engaging concave with which the resin comes into close contact at the time of the insert molding.

3. The electrical apparatus according to claim 1, wherein each of the grooves linearly extends in a direction substantially perpendicular to a bus bar of the blade in which the groove is formed.

4. The electrical apparatus according to claim 2, wherein each of the grooves linearly extends in a direction substantially perpendicular to a bus bar of the blade in which the groove is formed.

5. The electrical apparatus according to claim 1, wherein each of the grooves is inwardly recessed in the blade in a manner that reduces a diameter of the blade.

6. The electrical apparatus according to claim 2, wherein each of the grooves is inwardly recessed in the blade in a manner that reduces a diameter of the blade.

7. The electrical apparatus according to claim 3, wherein each of the grooves is inwardly recessed in the blade in a manner that reduces a diameter of the blade.

8. The electrical apparatus according to claim 1, wherein the resin facing parts are formed in a plate shape without any through hole.

9. The electrical apparatus according to claim 2, wherein the resin facing parts are formed in a plate shape without any through hole.

10. The electrical apparatus according to claim 3, wherein the resin facing parts are formed in a plate shape without any through hole.

11. The electrical apparatus according to claim 4, wherein the resin facing parts are formed in a plate shape without any through hole.

12. The electrical apparatus according to claim 1, wherein the apparatus is an AC adapter which generates direct-current power from the commercial power source.

13. The electrical apparatus according to claim 2, wherein the apparatus is an AC adapter which generates direct-current power from the commercial power source.

14. The electrical apparatus according to claim 3, wherein the apparatus is an AC adapter which generates direct-current power from the commercial power source.

15. The electrical apparatus according to claim 4, wherein the apparatus is an AC adapter which generates direct-current power from the commercial power source.

16. The electrical apparatus according to claim 5, wherein the apparatus is an AC adapter which generates direct-current power from the commercial power source.

17. A method of manufacturing an electrical apparatus which is adapted to be connected to a commercial power source, wherein the electrical apparatus includes a case that is made of resin and houses a functional member, and blades to be connected to the commercial power source, the method comprising:

forming a groove all the way around an outer periphery of each of the blades in a resin facing part thereof, wherein the resin facing part of each of the blades faces the resin of the case in the completed electrical apparatus;

loosely disposing cylindrical elastic members around the resin facing parts, respectively, to cover the resin facing parts by the elastic members;

inserting the blades in a metal mold such that the elastic members are disposed in the mold;

injecting the resin into the mold such that the elastic members are pressed into the grooves in the resin facing parts, respectively, thereby causing the elastic members to have fitting convexes which come into close contact with the grooves, respectively, and engaging concaves with which the resin comes into close contact; and solidifying the resin.

* * * * *